United States Patent [19]

Veerkamp

[11] 4,385,478

[45] May 31, 1983

[54] FOLDING AND PACKING MACHINE FOR PANTYHOSE

[75] Inventor: Bernard H. Veerkamp, Charlotte, N.C.

[73] Assignee: Hosiery Corporation of America, Inc., Philadelphia, Pa.

[21] Appl. No.: 182,559

[22] Filed: Nov. 6, 1980

[51] Int. Cl.[3] ..... B65B 43/26; B65B 63/04

[52] U.S. Cl. ..... 53/118; 53/570

[58] Field of Search ..... 53/430, 117, 118, 570; 242/74; 223/43

[56] References Cited

U.S. PATENT DOCUMENTS

| | | | |
|---|---|---|---|
| 1,793,104 | 2/1931 | Larsen | 242/81 |
| 1,977,668 | 10/1934 | Dallas | 242/81 |
| 2,249,379 | 7/1941 | Ford | 242/81 |
| 2,567,387 | 9/1951 | Link | 242/74 X |
| 2,826,376 | 3/1958 | Wallin | 242/81 |
| 3,842,568 | 10/1974 | Spencer | 53/118 X |
| 3,956,866 | 5/1976 | Lattur | 53/570 |

FOREIGN PATENT DOCUMENTS

| | | | |
|---|---|---|---|
| 130845 | 5/1947 | Australia | 53/118 |

*Primary Examiner*—John Sipos

*Attorney, Agent, or Firm*—Howard I. Podell

[57] ABSTRACT

A machine for wrapping a pair of pantyhose and sealing it in a pouch. The machine comprises a tray upon which a length of pantyhose may be laid, a rotating shaped hollow spindle extending transversely through an opening in the tray, with openings in the spindle through which air is drawn in so as to grab an intermediate section of each of the two legs of a length of pantyhose resting on the tray, and rotate the pantyhose into a compact cylindrical bundle about the spindle. A shaped pusher unit is loosely fitted about the spindle with the pusher unit serving, when activated, to push the bundle off the end of the spindle and into an outlet tube which is located so as to drop the pantyhose bundle into an open packaging envelope suspended below the tube. The envelope, when loaded with the pantyhose bundle is then heat sealed by conventional heated clamps and dropped onto a delivery conveyor belt.

8 Claims, 8 Drawing Figures

FOLDING AND PACKING MACHINE FOR PANTYHOSE

BACKGROUND OF THE INVENTION

It is customary to manually wrap pantyhose into individual envelopes after an inspection process during which sections of the pantyhose may be stretched out over wire frames. The manual process includes manual folding of the hose into the envelope. A pantyhose is of an irregular shape comprising two individual leg sections joined to a common panty section.

The prior art includes machinery for enclosing articles in open bags which are supplied on a continuous strip fed from a roll, with the loaded bag automatically heat sealed and detached from the feed strip. However, to load any irregular shaped article such as a pantyhose into such bags has customarily required the use of manual labor or of machinery fitted with cumbersome arms that fold the textile article along various hinge axes.

SUMMARY OF THE INVENTION

My invention is a machine for wrapping a pair of pantyhose and sealing it in a pouch. The machine comprises a tray upon which a length of pantyhose may be laid, a rotating shaped hollow spindle extending transversely through an opening in the tray, with openings in the spindle through which air is drawn in so as to grab an intermediate section of each of the two legs of a length of pantyhose resting on the tray, and rotate the pantyhose into a compact cylindrical bundle about the spindle. A shaped pusher unit is loosely fitted about the spindle with the pusher unit serving, when activated, to push the bundle off the end of the spindle and into an outlet tube which is located so as to drop the pantyhose bundle into an open packaging envelope suspended below the tube. The envelope, when loaded with the pantyhose bundle is then heat sealed by conventional heated clamps and dropped onto a delivery conveyor belt.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
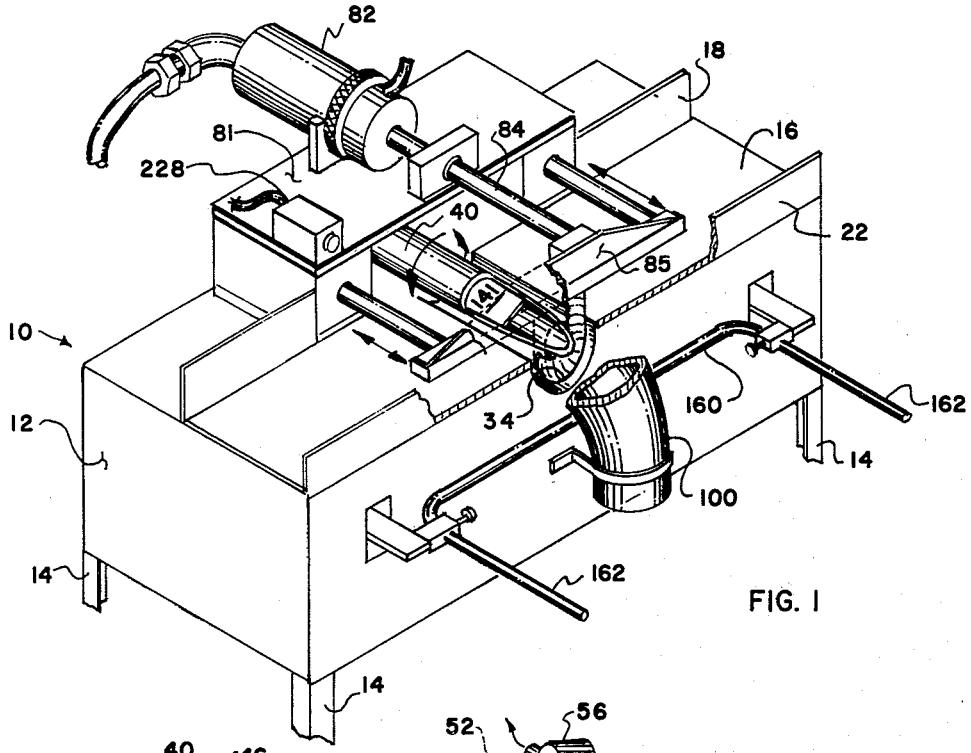
FIG. 1 is a top perspective view of the invention.
Figure 5:
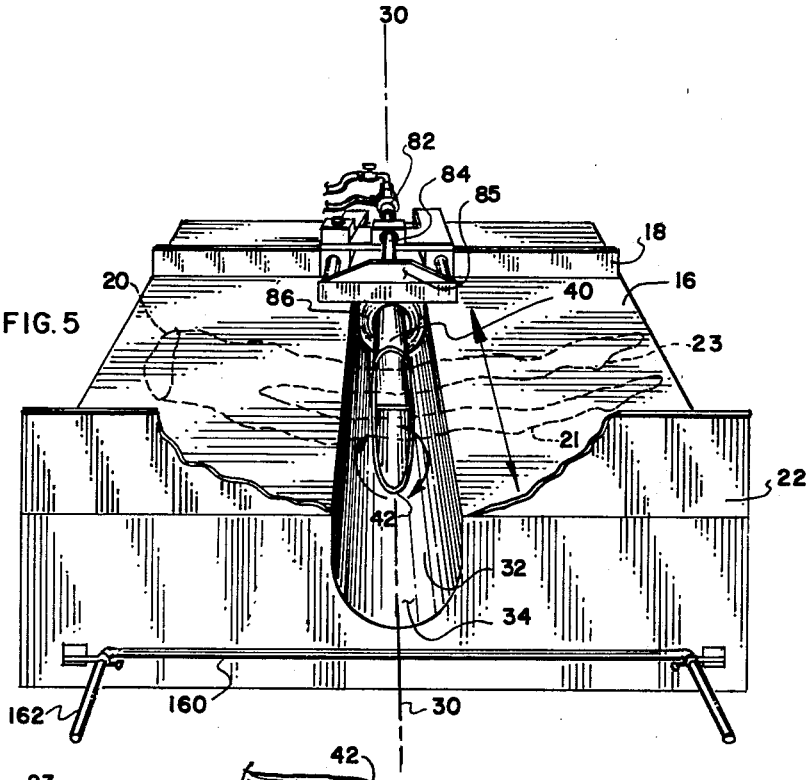
FIG. 5 is a top perspective view of the apparatus in use.

Turning now descriptively to the drawings, in which similar reference characters denote similar elements throughout the several views, FIG. 1 is a perspective view of the invention 10 which comprises a housing 12 supported on legs 14. A tray 16 extends along the top surface of housing 12 bounded by rear vertical extending wall 18 and front vertical extending wall 22 so that, as shown in FIG. 5, a length of pantyhose 20 may be laid along the length of tray 16, with the pantyhose 20 extending on both sides of transverse mid-axis 30. The tray 16 and walls 18 and 22 are intersected by a transverse slotted opening 32 extending in side view as a semi-circular opening section lying below axis 30 and extending in walls 18, 22 vertically above the plane of tray 16. A concave partly cylindrical wall 34 is formed as a bottom plate to opening 32 and joined to tray 16 on each side of opening 32.

A hollow spindle 40 is mounted along axis 30, with the end top 42 of spindle 40 exiting short of the vertical plane of front wall 22. Spindle 40 extends transversely into housing 12, being rotatably mounted by spaced bearing plates 46 joined to sleeve 48 which is internally fixed to the housing structure. A tube 52 is joined to the sleeve 48 so as to communicate to the interior of sleeve 48.

The interior of sleeve 48 is normally maintained at a partial vacuum by suction through tube 52, which is led to a vacuum pump 56. Openings 58 in the wall of spindle 40 are located in the spindle section enclosed by sleeve 48, with spindle 40 restrained by thrust bearings in plates 46 from axial movement. The rear end 59 of spindle is closed with the front tip section open as described hereinafter.

A pusher unit 80 is mounted freely about spindle 40 in opening 32, actuated by an air cylinder 82 fixed to the top wall 81 of the housing structure. The free end of rod piston 84 of the cylinder is fixed to angle 85 to which pusher head 86 is mounted. Pusher head 86 is preferably formed of a polished plastic material or Teflon type plastic and is shaped with a concave forward central wall 88 concentrically located about spindle 40. Angle member 80 is fastened to two spaced guide rods 89 that travel through slide bushings 87 fixed to the structure of the housing, so as to prevent rotation of pusher unit 80 about spindle 40.

The front face of wall 88 of pusher unit 80 normally lies flush with or behind wall 18 with actuation of air cylinder 82 causing rod 84 to drive the pusher unit completely across tray 16 to beyond the front wall 22 so as to push any article that is wound about spindle 40 into outlet tube 100.

Figure 2:
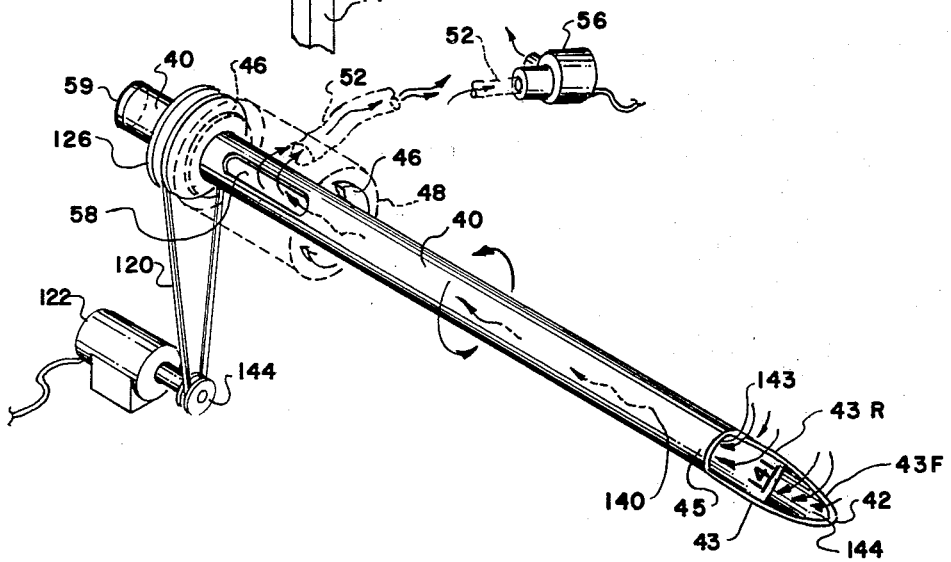
FIG. 2 is a detail perspective view of the spindle unit.
Figure 3:
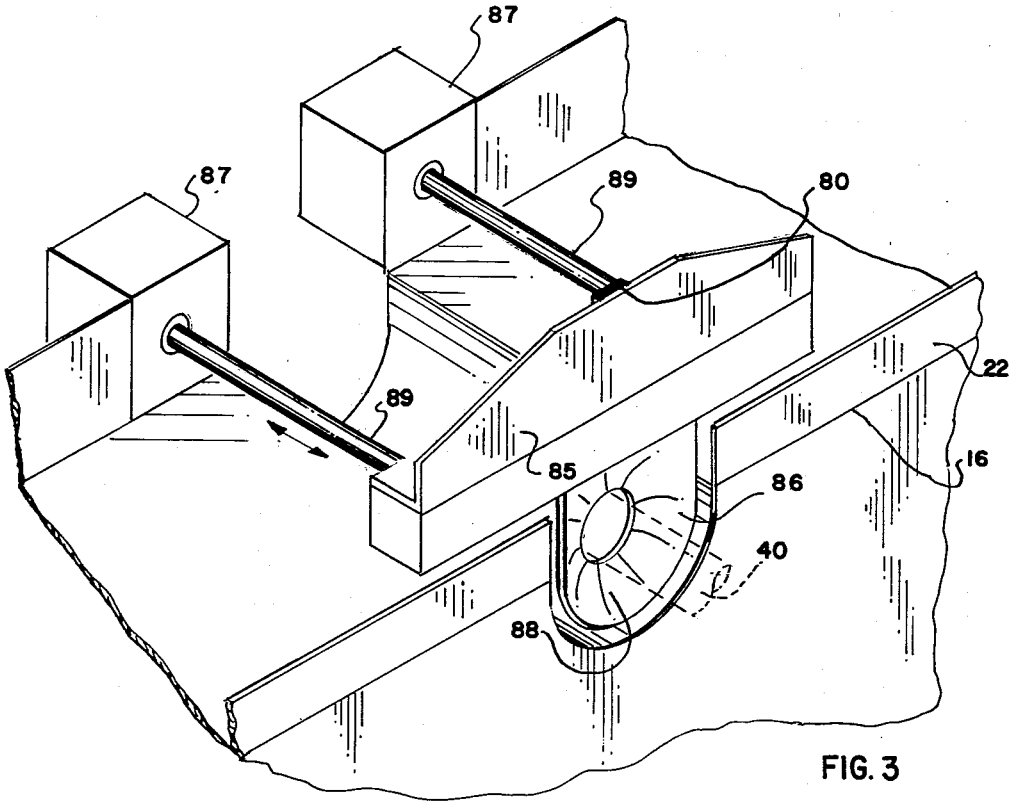
FIG. 3 is a detail perspective view of the pusher unit.

Spindle 40 is formed with a shaped front spoon-shaped tip section 43 that extends about approximately 180 degrees of the circumference of the rod outline, and forward of the forward end section 45 of the full rod circumference for a length that is substantially equal to the width of tray 16. A flat solid plate section 141 is fixed to the top of the tip section 43 to extend approximately one-half of the length of tip section 43 from tip 42 so that air is sucked into a first opening 143 near the rear of tip section 42 and into a second opening 144 near the front of tip section 42 to provide two spaced ports leading into the interior 140 of spindle 40. With the spindle 40 visualized in the position shown in FIGS. 1 and 2, the tip 42 is at the low point of rotation about the spindle axis and port 143 enters into the upper portion of spindle interior 140, with port 144 entering into the lower portion of the spindle interior 140. Consequently air flow into the interior 140 is divided relatively evenly through the two ports 143, 144 creating two equal amounts of suction across the length of tip section 43. As a result, when a pantyhose 20 is loosely dropped, manually onto tray 16, with one pantyhose leg portion 21 lying across the forward section 43F of tip section 43 and the other pantyhose leg portion 23 lying across the rear section 43R of tip section 43, as shown in FIGS. 5 and 7, each leg portion is separately held by suction to the spindle.

In practice, the spindle 40 continuously rotates at a preferred speed of 1100 RPM, being driven by belt 120 driven by pulley 124 of motor 122, with belt 120 fitting about pulley 126 fixed to the rear end of the spindle 40.

Figure 6:
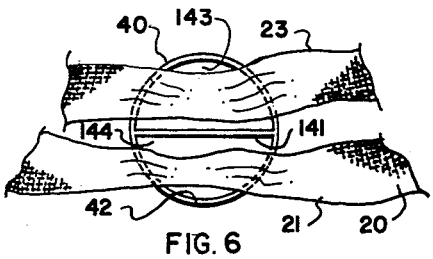
FIG. 6 is a detail end view of the pantyhose legs initially resting on the spindle tip section.
Figure 7:
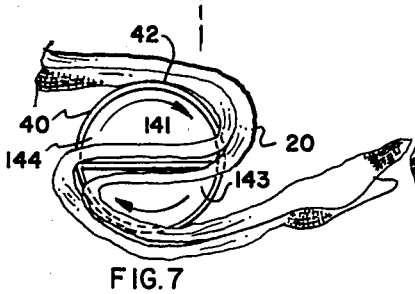
FIG. 7 is a view similar to FIG. 6, but after a first time interval.
Figure 8:
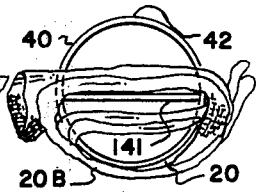
FIG. 8 is a view similar to FIG. 6, but after a second time interval.

The suction results in the both legs and the panty section of the pantyhose being rapidly wrapped into a cylindrical-shaped bundle 20B, as shown in FIGS. 6–8.

A manual or pedal switch 130 is then actuated by the operator to actuate air cylinder 82 to move piston rod 84 towards the forward position from wall 18 past front wall 22, with pusher head 86 compressing the rear end of bundle 20B into a somewhat semi-spherial shape as bundle 20B is pushed off spindle 40 through fixed tube 100 and bundle 20B then drops freely into an open plastic pouch 200 which is fed from a continuous strip 210 on a conventional bagging machine 220 to which the apparatus 10 is detachably fastened. The air cylinder automatically retracts the piston rod at the end of the stroke to prepare for the repetition of the cycle.

Figure 4:
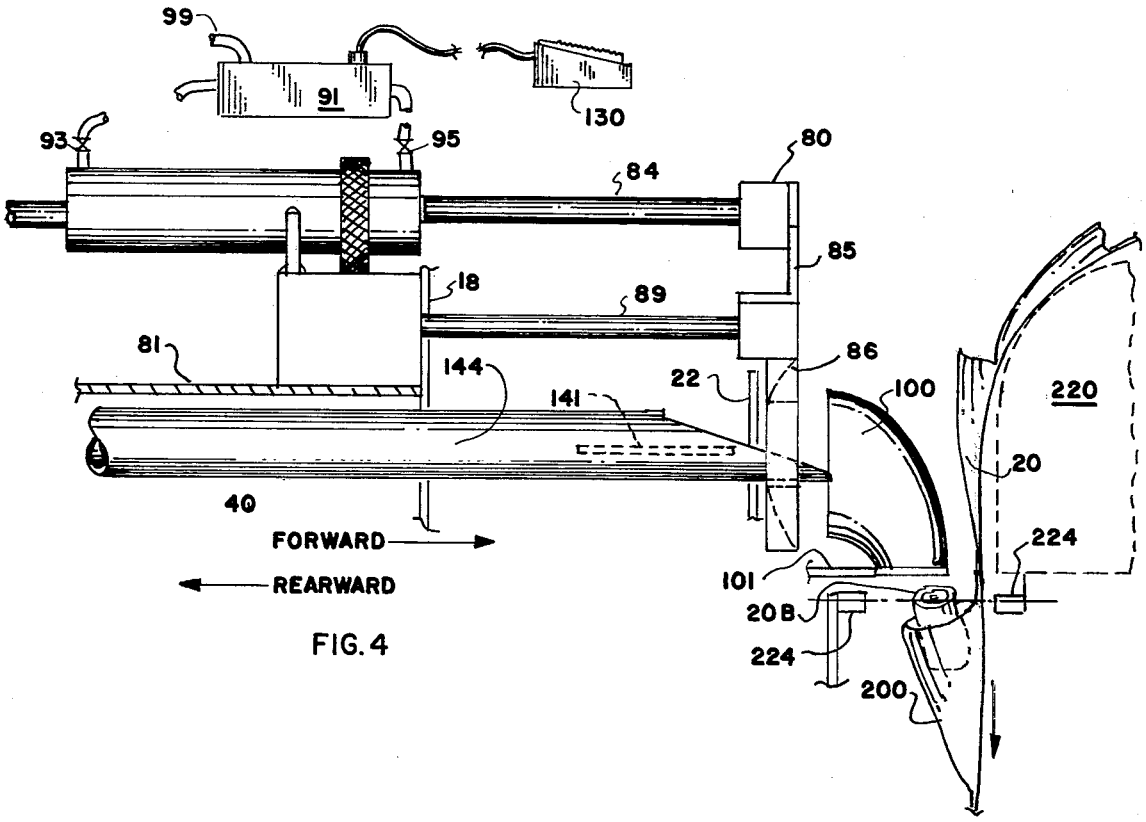
FIG. 4 is a side view of the spindle and pusher unit.

A U-shaped guide rod 160 is clamped to the exterior of housing 12 so that a pair of spaced leg sections 162 project horizontally away from the forward face of the apparatus 10, with each leg 162 being detachably clamped to a standard bagging machine 220 mounted as shown in FIG. 4 so that the output mouth 102 of the delivery tube 100 lies just above the open pouch 200 of bag 200 that extends between the heat sealing clamps 224 of bagging machine 220. A limit switch 228 is mounted on housing wall 81 so as to be actuated by angle 85 upon the completion of the rearward return stroke of pusher assembly 80 to actuate the cycle mechanism of bagging machine 220 which upon actuation of switch 228 causes heat seal clamps 224 to seal the filled pouch 200 and actuates machine 220 to separate the filled pouch 220 from roll 222 and advance a new open pouch 200 into loading position.

The air cylinder 82 is connected to the air supply line 89 by a four-way electrically actuated valve 91, with air pressure supplied by valve 91 regulated by adjustable check valves 93, 95 so as to independently control the rate of travel of piston 84 in the forward and the rearward directions. It is preferable for the valves 93, 95 to be regulated so that forward travel of pusher head 86 is rapid, upon actuation of switch 130, with operator release of switch 130 resulting in valve 91 reversing the air to cylinder 82 to cause rearward travel and with the check valves set so that the rearward travel is relatively slow so as to provide a time-delay period of actuation of switch 228 equal to the time required for bundle 20B to drop fully into pouch 200 prior to actuation of switch 228 upon rearward return of the pusher head unit. A typical complete cycle of the pusher head unit is less than one second in production use, upon actuation of switch 130.

The invention in use has been found to be efficient in uniformly wrapping a pantyhose unit into a small compact bundle and dropping it into an open pouch, with a consequent saving of time and expense as compared to the former procedure of manually wrapping a pantyhose unit into a bundle and manually placing the wrapped bundle into an open pouch of the bagging machine 200.

It is to be particularly noted that there is no tearing or other damage of the fine threads of the pantyhose legs caused by the invention. The ports of the spindle both open directly at an incline to the vertical planes and are open towards the forward direction so that hose material sucked into the ports may freely move in the forward horizontal direction when pushed by the pusher head without any physical horizontal impedance other than the suction force of air drawn into the ports. The tip 42 and the walls of the tip section 43 of the spindle 40 lie preferably along the circumference of the spindle and preferably do not project radially inwards and the plate 141 is fixed in a horizontal plane. Consequently, there is no detent or vertical surface to cause a snag or to catch a fine thread of the pantyhose while it is being pushed off of the spindle. All edges of the spindle section 43 are preferably smooth and rounded.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. Apparatus for forming a flexible article, such as a pantyhose having a main body and a pair of leg sections, into a bundle of a size that is insertable into an open packaging enclosure such as a sealable pouch, comprising, rotatable means formed with an open free end section, having a pair of spaced biased ports each dimensioned to receive thereon one of said leg sections;

suction means communicating with said ports whereby upon rotation of said rotatable means, said article is rolled into a bundle adhering detachably thereto;

reciprocating pusher means axially movable on said rotatable means for pushing a bundle of flexible material, when said bundle is coiled about said rotatable means such that said bundle may fall into an open packaging enclosure suspended adjacent said apparatus;

said rotatable means comprises a rotatable spindle formed with a hollow interior chamber, with said spindle terminating at said free end in a spoon-shaped section formed as a concave section terminating in a tip with the interior chamber of the spindle communicating with said concave section of the spoon-section through said two spaced ports separated by a plate section extending axially in said spindle over and covering a part of said concave section of said spoon-shaped section leaving the remaining part of said concave section uncovered whereby a first of said two ports extends axially of said spindle on the side of the plate that covers said concave section of said spoon-shaped section, and the second port extends axially on the other side of said plate where the concave section is uncovered, whereby suction in the interior of said spindle will result in a substantially linearly axial flow of ambient air into each of said two spaced ports constituting said suction means.

2. The apparatus as recited in claim 1, further comprises sealed sleeve means mounted about a portion of said hollow spindle so as to form an enclosed chamber in the sleeve means, exterior of the spindle, together with at least one opening in the wall of the spindle within said sleeve whereby said chamber in said sleeve means communicates with the interior chamber of the spindle, with an outlet opening in said sleeve attachable to a tube leading to a suction pump, and with at least one port opening in the spindle leading from the interior chamber adjacent the tip end of said free end section, whereby reduced air pressure inside of said interior chamber caused by suction in said tube serves as said suction means for detachable engagement of the flexible article to said free end section of the spindle.

3. The apparatus as recited in claim 2, wherein said spoon-shaped section is formed with an inclined opening in the wall of the spindle extending away from said tip end section in the axial direction of the spindle, with the axial length of said opening being substantially equal to the length of the tip end section of said spindle, said tip end section increasing in circumference in the axial direction extending away from the tip of the spindle.

4. The apparatus as recited in claim 1, in which said pusher means is formed with a concave shaped surface facing said tip end section of said spindle, said pusher means mounted freely about the spindle and fitted with propulsion means to move said pusher means from an initial position over an intermediate section of said spindle in the direction of said tip of said spindle to or beyond the top, said propulsion means being adapted to return said pusher means to their initial position, said concave surface serving to restrain said bundle on said spindle from increasing in diameter as the concave surface of said pusher means engages an end of said bundle in pushing said bundle off of the spindle.

5. The apparatus as recited in claim 4, in which a shaped outlet tube is mounted to the apparatus so as to freely enclose said bundle after it is pushed off of said spindle and while it is falling into a packing enclosure under the end of said outlet tube.

6. The combination of the apparatus as recited in claim 1 with machine means which delivers an open packaging enclosure to a location where said bundle may drop into said enclosure; said machine means having sealing means to seal the said enclosure, said apparatus having means for detachable engagement with said machine means; and switch means responsive to the position of said pusher means connected to said machine means so as to actuate said sealing means in automatic sequence upon the return stroke of said pusher means after a bundle has been dropped from the apparatus into the enclosure, to separate the filled enclosure from a roll of such enclosures and to advance the next enclosure into loading position.

7. The combination of claim 6 wherein said seal means comprised spaced heat clamps.

8. The combination of claim 7, further including an output pouch on said machine means intermediate said clamps for receiving said bundle therein with an exposed portion adapted to be contacted by said clamps for sealing said output pouch.

* * * * *